United States Patent [19]

Kikuchi

[11] Patent Number: 4,473,042

[45] Date of Patent: Sep. 25, 1984

[54] CYLINDER BLOCK

[75] Inventor: Kazuhiro Kikuchi, Yokohama, Japan

[73] Assignee: Nissan Motor Co., Ltd., Yokohama, Japan

[21] Appl. No.: 415,729

[22] Filed: Sep. 7, 1982

[30] Foreign Application Priority Data

Sep. 9, 1981 [JP] Japan ..... 56-133788[U]

[51] Int. Cl.[3] ..... F02F 7/00

[52] U.S. Cl. ..... 123/195 R; 123/195 S; 123/195 H; 123/41.72

[58] Field of Search ..... 123/195 R, 195 S, 195 C, 123/195 H, 41.72, 41.74

[56] References Cited

U.S. PATENT DOCUMENTS 2,027,940 1/1936 Vincent ..... 123/195 R 2,378,045 6/1945 Sorensen et al. ..... 123/41.72

2,436,729 2/1948 Paxman ..... 123/195 R

*Primary Examiner*—Craig R. Feinberg

*Assistant Examiner*—David A. Okonsky

*Attorney, Agent, or Firm*—Schwartz, Jeffery, Schwaab, Mack, Blumenthal & Koch

[57] ABSTRACT

The cylinder block comprises an oil pan installation rail which is integral with a skirt section at a lower part of the skirt section. The installation rail is generally in the shape of a quadrangular pyramid whose width and height gradually increase in the direction from the cylinder block front end to the cylinder block rear end. The oil pan installation rail is hollow. Additionally, a transmission installation section is integral with the rear end of the oil pan installation rail and also integral with the cylinder block. In this cylinder block, engine noise reduction can be effectively achieved while attaining engine weight reduction.

4 Claims, 3 Drawing Figures

CYLINDER BLOCK

BACKGROUND OF THE INVENTION

1. Field of the Invention

This invention relates to a cylinder block of an automotive internal combustion engine, configurated to reduce vibration noise emitted therefrom.

2. Description of the Prior Art

In connection with automotive engine cylinder blocks, they are usually formed with a so-called skirt section which is integral with the side wall sections of the cylinder block and defines thereinside the upper part of a crankcase chamber. The skirt section is formed at its lower part with a flange to which an oil pan is secured. However, such a conventional cylinder block is usually not provided with any special measure to increase the rigidity against flexure and torsion applied to the cylinder block. Accordingly, the cylinder block tends to generate flexural and torsional vibrations, thereby emitting vibration noise from the cylinder block itself. Additionally, such cylinder block vibration induces vibration of the oil pan and the like covers, thus further increasing noise emission from the engine.

SUMMARY OF THE INVENTION

A cylinder block according to the present invention comprises an oil pan installation rail to which an oil pan is to be secured. The oil pan installation rail is integral with a skirt section of the cylinder block at the lower part and generally in the shape of a quadrangular pyramid whose width and height gradually increase in the direction from its front end to its rear end. The oil pan installation rail is hollow. Additionally, a transmission installation section to which a transmission is secured is integral with the cylinder block. The transmission installation section is integral with the rear end of the oil pan installation rail. In the thus configurated cylinder block, the rigidity of the cylinder block itself and the connection-rigidity with the transmission can be greatly improved without a considerable weight increase, thus effectively suppressing noise emission from the engine while achieving weight reduction.

BRIEF DESCRIPTION OF THE DRAWINGS

The features and advantages of the cylinder block according to the present invention will be more clearly appreciated from the following description taken in conjunction with the accompanying drawings in which the same reference numerals designate the same parts and elements, and in which.

DETAILED DESCRIPTION OF THE INVENTION

Figure 1:
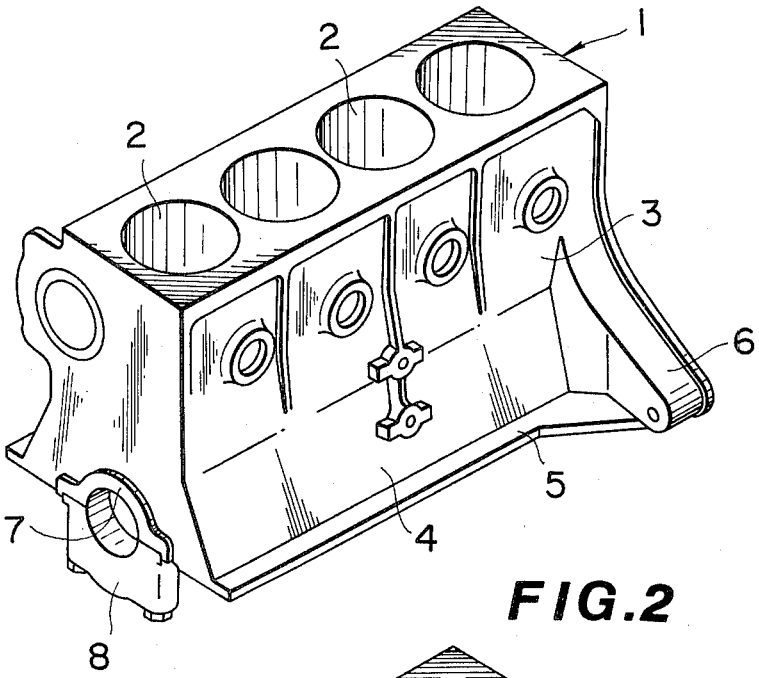
FIG.1 PRIOR ART
FIG. 1 is a perspective view of a conventional cylinder block.

Referring to FIG. 1, a conventional cylinder block 1 of the so-called half-skirt type of automotive engine will be described along with its major shortcomings. The cylinder block 1 is formed at its upper part with a plurality of cylinder-barrels 2. A water jacket (not shown) through which engine coolant flows is formed between a side wall 3 and the cylinder-barrels 2. Additionally, a so-called skirt section 4 is integral with the lower part of the side-wall 3 and extends downwardly. The skirt section 4 is widened downwardly forming an inclined flat surface as shown in FIG. 1; otherwise the skirt section may be bulged outwardly. The skirt section 4 has an oil pan installation flange 5 formed along its bottom edge to which an oil pan (not shown) is secured. The oil pan installation flange 5 extends from the front end of the cylinder block 1 toward the rear end of the cylinder block 1 to which a transmission is to be installed. Projected laterally and outwardly from the rear end part of the cylinder block 1 is a transmission installation section 6 to which the transmission is secured. The transmission installation section 6 is integral with the oil pan installation flange 5. Additionally, a plurality of main bearing support sections 7 are formed inside of the skirt section 4 and integral with the cylinder block 1. A plurality of main bearing caps 8 are securely attached to the main bearing support sections 7 so as to rotatably support a crankshaft through main bearing metals located between the main bearing support sections and main bearing caps 8.

However, in such a conventional cylinder block configuration, special measures are not taken in order to improve the rigidity against flexure in the upward-and-downward direction and in the rightward-and-leftward direction. Therefore flexural and torsional vibrations tend to be generated in the cylinder block by vibrational input from the crankshaft, which vibrational input is due to impact force by combustion within the cylinder-barrels. As a result, the cylinder block itself emits high level noise, while vibrating the oil pan, which serves as a secondary noise source. Besides, in the conventional cylinder block configuration of FIG. 1, the connection-rigidity between the transmission and the cylinder block rear end is relatively low, and accordingly the natural frequency of the combined vibration of the cylinder block and transmission vibrations becomes lower, thereby increasing low-frequency noise within the passenger compartment.

Figure 2:
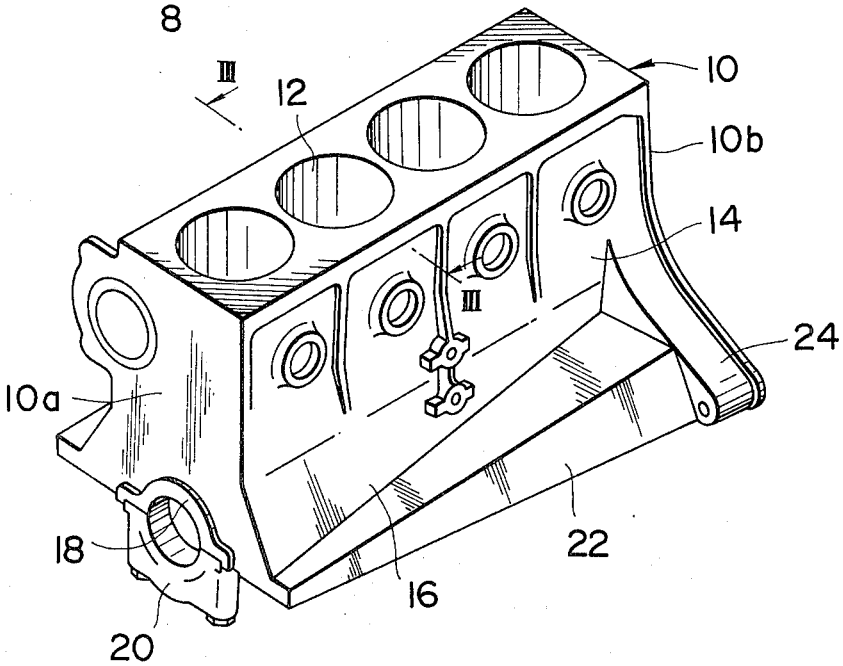
FIG. 2 is a perspective view of a preferred embodiment of a cylinder block in accordance with the present invention.
Figure 3:
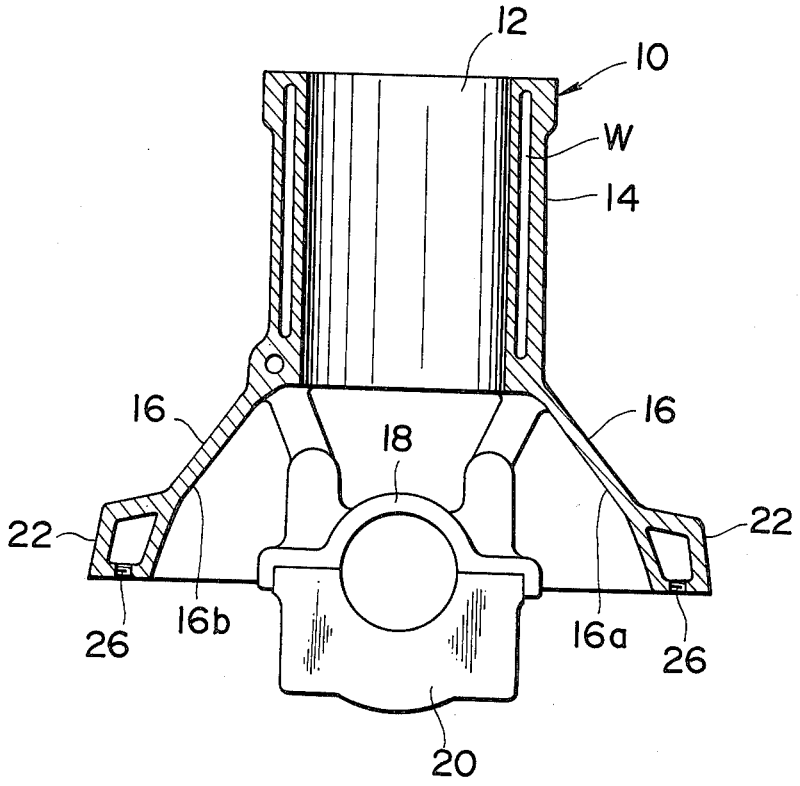
FIG. 3 is a vertical sectional view taken substantially along the line III-III of FIG. 2.

In view of the above description of the conventional cylinder block, reference is now made to FIGS. 2 and 3 wherein a preferred embodiment of a cylinder block of the present invention is illustrated by the reference numberal 10. The cylinder block 10 is formed at its upper part with a plurality of cylinder-barrels 12. The cylinder-barrels 12 are located between two opposite side wall sections 14 of the cylinder block 10 in a manner to form a water jacket W. Engine coolant flows in the water jacket W between the cylinder-barrels and each side wall section 14. A so-called skirt section 16 includes oppositely disposed side walls 16*a*, 16*b* each of which is formed integrally with the lower part of a cylinder block side wall section 14 and extends from the front end section 10*a* of the cylinder block 10 to the rear end section 10*b* of the cylinder block 10, to which rear end section a transmission (not shown) is to be securely connected. The skirt section 16 also extends downwardly and widens downwardly so as to define thereinside the upper part of a crankcase.

A plurality of main bearing support sections 18 are disposed inside of the skirt section 16 and are integral with the cylinder block 10. Additionally, a plurality of main bearing caps 20 are secured to the main bearing support sections 18, respectively. The journal of a crankshaft (not shown) is rotatably supported between each main bearing support section 18 and each main bearing cap 20 through a bearing metal (not shown).

As shown, two oppositely disposed oil pan installation rails 22 are located at the lower part of the cylinder block 10 and extend parallel to each other along the length of the cylinder block 10, i.e., in the direction from the cylinder block front end section 10*a* toward the cylinder block rear end section 10*b*. Each oil pan installation rail 22 is integral with the lower part of one of the skirt section walls 16*a*, 16*b*. The oil pan installation section 22 is generally in the shape of a quadrangular pyramid whose width and height are generally the same. The width and height of the oil pan installation section gradually increase in the direction from the cylinder block front end section 10*a* to the cylinder block rear end section 10*b*. The oil pan installation rail 22 is formed hollow as best shown in FIG. 3. The hollow interior is formed, for example, during casting, or by machining after casting. The oil pan installation rail 22 is integral at its rear end with one of two transmission installation sections 24 which are integral with and extend oppositely laterally from the cylinder block rear and section 10*b*. The rear end of the oil pan installation rail 22 is located in the vicinity of the cylinder block rear end section 10*b* and is largest in width and height.

As shown in FIG. 3, each oil pan installation rail 22 is formed at its bottom wall 20*b* with bolt holes 26 in which bolts (not shown) are disposed to secure the oil pan to the oil pan installation rails 22. It is to be noted that when the hollow oil pan installation rails 22 are formed by casting, cores (not shown) corresponding to the hollows of the rails 22 can be supported through these bolt holes 26.

With the thus configurated cylinder block 10, the oil pan installation rails 22 serve as reinforcement members, and therefore the cylinder block 10 is greatly improved in rigidity against flexure and torsion applied to the cylinder block. Furthermore, each oil pan installation rail 22 is hollow and so formed that the width and height gradually increase from the cylinder block front end section toward the cylinder block rear end section. Therefore, flexural and torsional vibrations of the cylinder block can be effectively suppressed with only minimum weight increase, thereby reducing noise emission from the cylinder block itself and from covers such as the oil pan. Moreover, since the oil pan installation rails 22 are integral with the transmission installation sections, the connection-rigidity between the transmission and the cylinder block 10 can be improved and accordingly noise generation from the transmission case is also suppressed, thereby noticeably reducing low-frequency noise within the passenger compartment.

As will be appreciated from the above, according to the present invention, the rigidity of the cylinder block itself and the connection-rigidity with the transmission can be improved without a considerable weight increase, thereby effectively reducing noise emission from the engine while preventing engine weight increase.

What is claimed is:

1. A cylinder block comprising:

a skirt section having a lower part;

a first oil pan installation rail to which an oil pan is to be secured, said first oil pan installation rail having a first end and a second end, being integral with the skirt section at the lower part and being generally in a shape of a quadrangular pyramid whose width and height gradually increase in a direction from said first end to said second end, said first oil pan installation rail being hollow; and a first transmission installation section integral with the cylinder block and to which section a transmission is to be secured, said first transmission installation section being integral with the second end of said first oil pan installation rail.

2. A cylinder block as claimed in claim 1, wherein said first oil pan installation rail has a width and a height which are generally the same, said first oil pan installation rail extending in a direction from a front end section of the cylinder block to a rear end section of the cylinder block to which the transmission is to be installed, in which the first and second ends of said oil pan installation rail are located in a vicinity of the front and rear end sections of the cylinder block, respectively.

3. A cylinder block as claimed in claim 1, further comprising a second ol pan installation rail located opposite said first oil pan installation rail, said second oil pan installation rail being integral with the skirt section at the lower part and generally in a shape of a quadrangular pyramid whose width and height gradually increase in a direction from a first end of said second rail to a second end of said second rail, said second oil pan installation rail being hollow.

4. A cylinder block as claimed in claim 3, wherein said first and second oil pan installation rails are integral with first and second side walls of the skirt section, respectively, said skirt section first and second side walls being located opposite to each other and extending in a direction from a front end section of the cylinder block to a rear end section of the cylinder block, the first and second side walls defining therebetween an upper part of a crankcase.

* * * * *